United States Patent [19]

Murphy et al.

[11] 4,282,296

[45] Aug. 4, 1981

[54] HIGH SPEED MAGNETOGRAPHIC IMAGING PROCESS

[75] Inventors: Cornelius B. Murphy; Donald S. Sypula, both of Fairport, N.Y.

[73] Assignee: Xerox Corporation, Stamford, Conn.

[21] Appl. No.: 145,172

[22] Filed: Apr. 30, 1980

[51] Int. Cl.[3] ..... G03G 19/00

[52] U.S. Cl. ..... 430/39; 430/122; 430/107; 430/97; 252/62.54; 252/62.56

[58] Field of Search ..... 430/39, 122, 107, 97; 252/62.54, 62.56

[56] References Cited

U.S. PATENT DOCUMENTS

| | | | |
|---|---|---|---|
| 3,043,685 | 7/1962 | Rosenthal | 430/122 X |
| 3,124,483 | 3/1964 | Rheinfrank | 430/107 X |
| 3,590,000 | 6/1971 | Palermiti | 430/110 |
| 3,601,091 | 8/1971 | Preckshot | 430/39 X |

*Primary Examiner*—John D. Welsh

*Attorney, Agent, or Firm*—E. O. Palazzo

[57] ABSTRACT

This invention generally is directed to methods for developing images, including latent magnetic and electrostatic images, which involves forming latent images on a suitable substrate and contacting the image with a toner comprising a polymeric esterification product of 1,4-benzene-dicarboxylic acid polymerized with 1,2,4-benzenetricarboxylic acid - cyclic 1,2-anhydride and 2,2-dimethyl-1,3-propane diol in a magnetic material. The toner composition described is particularly useful in a magnetic imaging system. The magnetic material can act as both the colorant and magnetic substance, or an additional colorant such as carbon black can be utilized.

5 Claims, No Drawings

HIGH SPEED MAGNETOGRAPHIC IMAGING PROCESS

BACKGROUND OF THE INVENTION

In the electrophotographic process, especially the xerographic process, and in magnetic imaging systems similar steps are involved in causing the formation and development of images, including for example the formation of a latent image, the development of the latent image with electromagnetic materials, such as toner, optionally, transferring the developed image to a suitable support such as paper, fusing the image to the paper substrate using a number of known techniques, including those employing heat, and optionally cleaning the surface from which the developed latent image has been transferred. In the xerographic process the photoconductive surface which contains an electrostatic latent image can be developed by means of a variety of pigmented resin materials specifically made for this purpose, such as toners. The toner material is electrostatically attracted to the latent image on the plate in proportion to the charge concentration thereon. These toner materials can be applied by a number of known techniques including for example, cascade development, reference U.S. Pat. No. 3,618,552, magnetic brush development, reference U.S. Pat. No. 2,874,063, and touchdown development, reference U.S. Pat. No. 3,166,432. The developed image is then transferred to a suitable substrate such as paper and can be fixed by using a number of different techniques including for example vapor fixing, heat fixing, pressure fixing or combinations thereof as described for example in U.S. Pat. No. 3,539,161.

In magnetic imaging systems substantially the same process steps are involved as described above with respect to electrophotographic imaging systems, thus there is formed a latent magnetic image on a magnetizable recording medium, which image can be used in duplicating processes, for example, by repetitive toning, and transfer of the developed image. The latent magnetic image is formed by any suitable magnetization procedure whereby a magnetizable layer of marking material is magnetized and such magnetism transferred imagewise to the magnetic substrate. The latent magnetic image can be developed with a magnetic developer to render such image visible. The developed visible magnetic image can then be typically tranferred to a receiver such as for example paper, which image is fused on the paper, in order to produce a final copy or print referred to in the art as a hard copy. There are a number of known techniques for creating the latent imate which are described for example in U.S. Pat. Nos. 4,032,923; 4,060,811; 4,074,276; 4,030,105; 4,035,810; 4,101,904; and 4,121,261, the teachings of these patents being completely incorporated herein by reference.

One method of developing magnetic images is referred to as magnetic toner touchdown development, which involves providing a substantially uniform layer of toner comprising magnetic material on a conductive substrate, which material can be brought either closely adjacent to that of the image or in contact with the image. The magnetic material in the toner acts as an extension of the conductive backing and therefore acquires charge, induced therein by the latent image of a polarity opposite to that in the latent image. The conductive substrate can be biased to assist in transfer of the toner to the latent image, however, a conductive backing is not essential.

Typical suitable fusing methods that may be used have been described in the prior art and include for example, heating the developed image (toner) to cause the resins thereof to at least partially melt and become adhered to the photoconductor binder member or copy substrate in the case of images transferred from the imaging media, followed by the application of pressure to the toner with heating such as the use of a heated roller. Solvent or solvent vapor fusing has also been used, wherein the resin component of the toner is partially dissolved. The photoconductor binder member or copy substrate is typically of sufficient hardness to allow fixing solely by the application of pressure such as for example by a contact roller and in an amount sufficient to calender the toner. With some existing toner materials, images are fixed using a heat pressure fusing system at surface speeds of up to 20 inches per second but recently it has been found desirable to achieve higher fixing speeds and special toner materials are needed in order to effect such high fixing speeds particularly in magnetic systems where the high magnetic pigment loading required for development can have an adverse effect on the desired fusing and fixing levels of the toner.

Concurrently with the growth of interest in magnetic imaging there has been increased interest in magnetic developers to render the latent magnetic images visible. In U.S. Pat. No. 3,221,315 there is described the use of encapsulated ferrofluids in a magnetic recording medium, wherein the ferrofluid orientation in the presence of a magnetic field exhibits a variable light responsive characteristic. In this situation the magnetic recording medium is self-developing in the sense that magnetic marking material need not be employed to render a visible image. In other situations latent magnetic images are rendered visible by magnetic marking materials. Thus, for example, in U.S. Pat. No. 3,627,682 there is disclosed binary toners for developing latent magnetic images, which binary toners include a particulate hard magnetic material and a particulate soft magnetic material in each toner particle. The toner particles include two materials in a binder material. In U.S. Pat. No. 2,826,634 there is described the use of iron or iron oxide particles either alone or encapsulated in low melting resin or binders for developing latent magnetic images. Low optical density and relative unresponsiveness to weak magnetic fields are exhibited by relatively large iron or iron oxide base magnetic particles.

Other patents evidencing the continuing interest in improved magnetic developers include U.S. Pat. No. 3,520,811, which discloses that magnetic particles of chromium dioxide appear to catalyze a surface polymerization or organic air drying film forming vehicles such as those employed in oil base materials in order that a coating of polymerized vehicle is formed around the particle; and U.S. Pat. No. 3,905,841 which teaches the prevention of agglomeration and the formation of homogeneous dispersions of cobalt-phosphorous particles into an organic resin binder by treatment with a solution containing sulfuric acid.

SUMMARY OF THE INVENTION

It is an object of the present invention to provide a method for developing latent images.

A further object of the present invention is the provision of a method using a specific toner composition for developing magnetic images.

A further object of the present invention is the provision of a method for developing magnetic images wherein a high speed fusing system is employed.

These and other objects of the present invention are accomplished by providing a method for developing latent magnetic and electrostatic images, preferably latent magnetic images, comprising forming a latent magnetic image on a magnetizable recording medium, contacting the image with a toner material, preferably a magnetic toner material comprising a polymeric esterification product of 1,4-benzenedicarboxylic acid polymerized with 1,2,4-benzenetricarboxylic acid-cyclic 1,2-anhydride and 2,2-dimethyl-1,3-propane diol and a magnetic material; optionally transferring the developed image to a suitable substrate such as paper, and subsequently permanently fusing the image to said substrate. The details of the magnetic imaging systems are outlined again on page 2 of the present application and are well known in the prior art as indicated herein. The invention herein resides in the use of a new magnetic toner composition which is the subject matter of a copending application filed on even date herewith for causing the development of magnetic images. The disclosure and working examples of the copending application are totally incorporated herein by reference.

The toner useful in the imaging method of the present invention is comprised of a polyester resin, and more specifically the polymeric esterification product of a 1,4-benzenedicarboxylic acid polymerized with 1,2,4-benzenetricarboxylic acid-cyclic 1,2-anhydride and 2,2-dimethyl-1,3-propane diol; a pigment or colorant, which pigment may be magnetic; and, as an optional ingredient, a carrier material when such toner is used in developing electrostatic latent images. When used in a magnetic imaging system, the toner composition contains a magnetic pigment as specified hereinafter. The magnetic pigment can function both as a magnetic material and as a colorant. However, a colorant such as carbon black can be used in addition to the magnetic material.

In a preferred embodiment of the present invention the polyester resin is used together with magnetic materials for employment in magnetic development systems. When used in such systems, especially when high speed fusing is desired, for example speeds of from about 20 inches per second, to about 50 inches per second, and preferably from about 35 inches per second to about 50 inches per second, it is preferred that at least about 50 percent by weight of magnetic material be present.

The polyester resin component, in one embodiment, is prepared by polymerizing 1,4-benzenedicarboxylic acid having the formula:

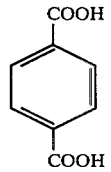

with 1,2,4-benzenetricarboxylic acid-cyclic 1,2-anhydride of the formula:

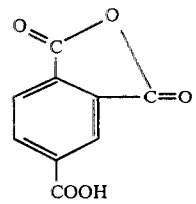

and 2,2-dimethyl-1,3-propane diol having the formula:

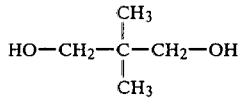

The polymerization occurs by the opening of the anhydride ring with the formation of the ester linkage as follows:

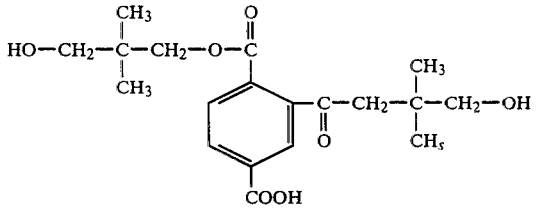

As the free carboxyl group in the 4-position may also react, there is branching occurring in the polymer. The terminal hydroxyl groups continue to react with other acids to make up the resulting polymer.

Generally, the toner composition of the present invention contains from about 10 percent to about 60 percent by weight of polyester resin, and preferably from about 25 percent to about 50 percent by weight of polyester resin; while the amount of magnetic material present ranges from about 40 percent to about 90 percent, and preferably from about 50 percent to about 75 percent by weight. The total amount of resin plus magnetic material is equal to 100 percent, thus when 65 percent by weight of magnetic material is present, 35 percent by weight of resin is present. These percentage ranges allow the achievement of good development, and the fusing of the resulting toner at high speeds, that is, approaching 35 to 50 inches per second. In one preferred embodiment of the present invention, the magnetic material is present in an amount of 65 percent by weight.

As indicated herein, there can be added to the toner composition a colorant such as carbon black, such colorant being present in an amount of about 5 percent to about 10 percent by weight. When carbon black is present, the amount of resin and/or magnetic material present will change accordingly. Thus, when 5 percent by weight of carbon black is present, the remaining components of the toner composition could be comprised of 40 percent by weight of polyester resin, and 55 percent by weight of the magnetic material. Greater and lesser amounts of carbon black can be employed providing there are no adverse effects when such a toner containing these amounts is used in an imaging system, especially a magnetic imaging system.

While any suitable colorant can be employed, illustrative examples include carbon black, nigrozine dye, aniline blue, chalco blue, chrome yellow, ultramarine blue, methylene blue chloride, phthalocyanine blue, mixtures thereof, and the like. Carbon black is the preferred colorant.

The fusing temperature range of the magnetic toner of the present invention is from about 300 degrees Fahrenheit (°F.) to about 390° F. and preferably from about 335° F. to about 360° F.

Illustrative examples of magnetic materials that may be used include magnetic oxides such as magnetites, like Mapico Black, metals such as iron, cobalt, and nickel, certain ferrites such as zinc, cadmium, manganese, various permalloys and other alloy materials such as cobalt-phosphorus, cobalt-nickel; and the like. Mapico Black is the preferred magnetic material.

Additional additives of various types may be added to or used in conjunction with the toners described herein in order to enhance process performance in one or more aspects, for example flow properties. For instance, Silanox 101 (fumed silica), zinc stearate or other suitable powder flow agents may be used with the toners to aid development. Certain plasticizers, such as diphenylphthalate, are known to dramatically alter the melt viscosity of toners, and may be used to substantially reduce the energy required to fuse the toners to a substrate, such as paper. In addition, surface treatment or blending of the toners with magnetic and/or conductive additives, for example, certain metal powders, magnetites or carbon blacks, can be used to impart desirable process characteristics, particularly for development, for the toners of this invention.

In electrophotographic systems any suitable carrier material can be emloyed when the toner of the present invention is used in a conventional xerographic imaging system as long as such particles are capable of triboelectrically obtaining a charge of opposite polarity to that of the toner particles. Thus for example, the carriers can be selected so that the toner particles acquire a charge of positive polarity and include such materials as sodium chloride, ammonium chloride, ammonium potassium chloride, Rochelle salt, sodium nitrate, aluminum nitrate, potassium chlorate, granular zircon, granular silicon, glass, steel, nickel, iron ferrites, silicon dioxide and the like. The carriers can be used with or without a coating. Coatings including fluorocarbon materials such as polyvinyl fluoride and polyvinylidene fluoride resins and the like may be used. Nickel carriers are also useful, these carriers being described in U.S. Pat. Nos. 3,847,604 and 3,767,598, incorporated herein by reference. Carrier particles of various diameters can be used, including those having a diameter of from about 50 to about 500 microns, thus allowing the carrier to possess sufficient density and inertia to avoid adherence to the electrostatic images during the development process. This carrier can be employed with the toner compositions in any suitable combination, however, best results are obtained when about 1 part per toner by weight is used, and about 10 to about 200 parts per weight of carrier.

The toners of the present invention may be prepared by various known methods such as spray drying or use of the Banbury/rubber mill process. In the spray drying method the appropriate polymer is dissolved in an organic solvent like toluene or chloroform or suitable solvent mixture. The toner colorant and/or pigments are also added to the solvent. Vigorous agitation, such as that obtained by ball milling processes assists in assuring good dispersion of the colorant or pigment. The solution is then pumped through the atomizing nozzle while using an inert gas, such as nitrogen, as the atomizing agent. The solvent evaporates during atomization resulting in toner particles of a pigmented resin. Particle size of the resulting toner varies depending on the size of the nozzle. However, particles of a diameter between about 0.1 microns and about 100 microns generally are obtained. Melt blending or dispersion processes can also be used for preparing the toner compositions of the present invention. This involves melting a powdered form of an appropriate polymeric resin and mixing it with suitable colorants and/or pigments. The resin can be melted by heated rolls, which rollers can be used to stir and blend the resin. After thorough blending, the mixture is cooled and solidified. The solid mass that results is broken into small pieces and subsequently finely ground so as to form free flowing toner particles which range in size of from about 0.1 to about 100 microns. Other methods for preparing the toners of the present invention include dispersion polymerization, emulsion polymerization and melt blending/cryogenic grinding.

The toner of the present invention may be of any suitable size, although particles ranging in size from about 3 microns to about 20 microns and preferably from about 4 microns to about 12 microns fuse particularly well in magnetic imaging systems employing flash fusing. When the particles are too fine, poor development with high background may occur.

DESCRIPTION OF PREFERRED EMBODIMENTS

The following examples further define and describe the toner compositions of the present invention and methods of utilizing them to develop latent magnetic or electrostatic images. Parts and percentages are by weight unless otherwise indicated.

EXAMPLE I

A toner comprised of 35 percent by weight of the polymeric esterification resin product of 1,4-benzenedicarboxylic acid polymerized with 1,2,4-benzenetricarboxylic acid-cyclic 1,2-anhydride and 2,2-dimethyl-1,3-propane diol and 65 percent by weight of the magnetite, Mapico Black, commercially available from Columbian Chemical Division of Cities Service Company was prepared by conventional milling and jetting techniques. The resulting black toner material has a volume average particle size of about 10.5 microns. This material was subsequently blended with about 0.4 percent by weight of a flow agent, Silanox 101, commercially available from Cabot Company to produce a free-flowing magnetic toner.

This toner, which has a minimum fuse temperature of 335° F., a minimum fusing latitude of 55° F. and a hot offset temperature of greater than 350° F. when used in a magnetic imaging system, as outlined above, produces images of uniform, high optical density and excellent resolution.

By minimum fuse temperature as used herein is meant the minimum temperature at which the toner material melts and sticks to a substrate such as paper. The hot offset temperature is the temperature at which some of the toner adheres to the fuser roll, particularly a fuser roll in an electrophotographic system, while the fusing latitude temperature is the difference in degrees Fahrenheit between the hot offset temperature and the minimum fuse temperature.

EXAMPLE II

The procedure of Example I was repeated with the exception that 55 percent by weight of magnetite.

This toner when used in a magnetic imaging system for developing magnetic images produced toner images of uniform high optical density, and excellent resolution.

EXAMPLE III

The procedure of Example I was repeated with the exception that the toner was comprised of 25 percent by weight of the resin, and 75 percent by weight of Mapico Black.

This toner when used in a magnetic system for developing magnetic images produced toner images of uniform high optical density and excellent resolution.

EXAMPLE IV

The procedure of Example I was repeated with the exception that there was substituted for the Mapico Black 65 percent by weight of a polyhedral shaped magnetite, MO-7029, commercially available from the Pigments Division of Pfizer Corporation. This toner was prepared by conventional spray drying techniques from a chloroform solution and the resulting black toner had a volume average particle size of about 12 microns.

This toner, when used in a magnetic imaging system for developing magnetic images, produced toner images of uniform high optical density, and excellent resolution.

EXAMPLE V

The procedure of Example I was repeated with the exception that in place of the Mapico Black there was used 65 percent by weight of an acicular magnetite, MO-4431, commercially available from Pfizer Corporation.

This toner when used in a magnetic imaging system for developing magnetic images, produced toner images of uniform high optical density, and excellent resolution.

EXAMPLE VI

The procedure of Example I was repeated with the exception that in place of the 65 percent by weight of Mapico Black there was used 60 percent by weight of K-378 magnetite, commercially available from Northern Pigment Limited, and 40 parts by weight of the resin, instead of 35 parts as used in Example I. This toner, which was prepared by spray dring, is subsequently dry blended with about 10 percent by weight of conductive carbon black. One part by weight of this toner is mixed with 100 parts by weight of a steel carrier in a steel container with stirring resulting in the formation of a developer material for use in an electrostatographic imaging system.

EXAMPLE VII

The procedure of Example I was repeated with the exception that the resulting toner had a volume average particle size of about 4.5 microns.

This toner when used in a magnetic imaging system for developing magnetic images produced toner images of uniform high optical density and excellent resolution.

EXAMPLE VIII

The procedure of Example I was repeated with the exception that the toner was comprised of 45 parts by weight of the resin, 55 parts by weight of the magnetite, Mapico Black, and 10 parts by weight of carbon black.

The resulting toner when used in a magnetic imaging system for developing magnetic images produced toner images of uniform high optical density and excellent resolution.

Although specific materials and conditions are set forth in the foregoing examples, these are merely intended as illustrations of the present invention. Various other suitable resins, magnetic substances, additives, pigments, colorants, and/or other components may be substituted for those in the examples with similar results. Other materials may also be added to the toner to sensitize, synergize or otherwise improve the fusing properties or other properties of the system.

Other modifications of the present invention will occur to those skilled in the art upon a reading of the present disclosure. These are intended to be included within the scope of this invention.

What is claimed is:

1. A method for developing magnetic latent images comprising forming a magnetic latent image on a suitable substrate, contacting the image with a dry magnetic toner consisting essentially of about 25 percent to about 50 percent by weight of a resin of a polymeric esterification product of 1,4-benzene dicarboxylic acid polymerized with 1,2,4-benzene-tricarboxylic acid-cyclic 1,2-anhydride and 2,2-dimethyl-1,3-propane diol, and from about 50 percent to about 75 percent by weight of a magnetic material selected from magnetites, metals, metal oxides, ferrites, and alloy materials, said toner having a fusing temperature of from about 300° Fahrenheit to about 390° Fahrenheit, transferring the image to a suitable substrate at a rate of above about 20 inches per second, and permanently affixing the image thereto by fusing at a temperature in excess of about 300° Fahrenheit.

2. A method of imaging in accordance with claim 1 wherein the magnetic material is Mapico black.

3. A method of imaging in accordance with claim 2 wherein the Mapico black is present in an amount of 65 percent by weight.

4. A method in accordance with claim 1 wherein there is added to the toner composition a colorant or flow agent.

5. A method in accordance with claim 1 including the further step of transferring the image to a suitable substrate followed by permanently fusing said image to said substrate.

* * * * *